United States Patent [19]

Tsubuko et al.

[11] Patent Number: 4,595,646

[45] Date of Patent: Jun. 17, 1986

[54] LIQUID DEVELOPER FOR ELECTROPHOTOGRAPHY

[75] Inventors: Kazuo Tsubuko; Junichiro Hashimoto, both of Numazu, Japan

[73] Assignee: Ricoh Company, Ltd., Tokyo, Japan

[21] Appl. No.: 558,265

[22] Filed: Dec. 5, 1983

[30] Foreign Application Priority Data

Dec. 6, 1982 [JP] Japan ..... 57-213669

[51] Int. Cl.[4] ..... G03G 9/12

[52] U.S. Cl. ..... 430/115

[58] Field of Search ..... 430/110, 115

[56] References Cited

U.S. PATENT DOCUMENTS 4,243,736 1/1981 Herrmann ..... 430/115

FOREIGN PATENT DOCUMENTS 56-2950 1/1981 Japan ..... 430/110

*Primary Examiner*—Roland E. Martin

*Attorney, Agent, or Firm*—Flynn, Thiel, Boutell & Tanis

[57] ABSTRACT

A liquid developer for electrophotography is disclosed, which comprises a highly electrically insulating carrier liquid with a low dielectric constant and a colorant comprising a pigment component treated with a humic acid component selected from the group consisting of humic acid, a humic acid salt and a humic acid derivative, and then coated with a resin component, which colorant is dispersed in the highly electrically insulating carrier liquid.

9 Claims, No Drawings

LIQUID DEVELOPER FOR ELECTROPHOTOGRAPHY

BACKGROUND OF THE INVENTION

The present invention relates to a liquid developer for electrophotography, and more particularly to a liquid developer for electrophotography comprising a high electrically insulating carrier liquid with a low dielectric constant and a colorant which has been treated with humic acid, a humic acid salt or a humic acid derivative and which coloring agent is dispersed in the high electrically insulating carrier liquid.

Conventionally, there are known liquid developers for electrophotography which comprise a colorant called toner which is dispersed uniformly in a high electrically insulating carrier liquid with a low dielectric constant, which toner is prepared by kneading an organic pigment or inorganic pigment such as carbon black or phthalocyanine blue with a resin and by pulverizing the kneaded mixture when hardened. In this colorant, the primary particles of the organic or inorganic pigment particles aggregate so strongly that they cannot be dispersed easily to the extent that those particles turn out to be of the primary particle size even if they are dispersed in a vehicle in a ball mill, in an attritor or in a heat roll mill.

Conventionally, there is known a flushing method for making a colorant, in which, for instance, carbon black is dispersed in water, the dispersion is then kneaded with a resin solution, so that the water which has covered the particles of carbon black is replaced with the resin solution, and thereafter the water and the solvent of the resin solution are removed. This method, however, has the shortcoming that fine particles of carbon black cannot be produced since carbon black is hydrophobic and therefore cannot be dispersed to its primary particle size. The result is that when the particles of carbon black are employed as the colorant for a liquid developer for electrophotography, it is extremely difficult to make images with high density, high contrast in terms of the contrast assessed by a grey scale, and excellent image fixing properties by the liquid developer due to the poor dispersing performance of the colorant in the solvent of the liquid developer. Furthermore, there has been proposed a method of adding to the aqueous dispersion of carbon black an anionic surface active agent, a nonionic surface active agent, a cationic surface active agent or a polymer dispersing agent for the synthesis of polymers. However, this method has not provided a solution to the problem of poor dispersion-capability of carbon black in water.

SUMMARY OF THE INVENTION

It is therefore an object of the present invention to provide a liquid developer for electrophotography which provides images with high density, high contrast and excellent fixing properties.

According to the present invention, this object has been attained by a liquid developer comprising a high electrically insulating carrier liquid with a low dielectric constant and a colorant which has been treated with humic acid, a humic acid salt or a humic acid derivative and which colorant is dispersed in the high electrically insulating carrier liquid.

DETAILED DESCRIPTION OF THE PREFERRED EMBODIMENTS

Examples of carbon black that can be employed as a pigment component in the colorant in the present invention are as follows: furnace black, acetylene black, channel black, commercially available carbon black such as Printex G, Special Black 15, Special Black 4 and Special Black 4-B (made by Degussa Japan Co., Ltd), Mitsubishi #44, #30, MA-11 and MA-100 (made by Mitsubishi Carbon Co.), Raben 30, Raben 40 and Conductex SC (made by Columbia Carbon Co.), Regal 800, 400, 660 and Blackpearls L (made by Cabot Corp.).

Examples of organic pigments that can be employed as another pigment component in the colorant in the present invention are as follows: Phthalocyanine Blue, Phthalocyanine Green, Sky Blue, Rhodamine Lake, Malachite Green Lake, Methyl Violet Lake, Peacock Blue Lake, Naphthol Green B, Naphthol Green Y, Naphthol Yellow S, Permanent Red 4R, Brilliant First Scarlet, Hansa Yellow, Benzidine Yellow, Lake Red C, Lake Red D, Brilliant Carmine 6B, Permanent Red F5R, Pigment Scarlet 3B and Bordeaux 10B.

In the present invention, it is preferable to use in the colorant a mixture of the organic pigment and carbon black with a mixing ratio of 1:2~20 in terms of parts by weight. When the ratio is below the above range, the control of the polarity of the colorant becomes insufficient for practical use and when the ratio exceeds the above range, the color tone of the images obtained deviates from a suitable black color range for copy images for office use.

It is necessary that the resin with which the pigment is coated be slightly soluble or insoluble in the carrier liquid (non-aqueous solvent). As such resin, for instance, natural-resin-modified phenolic resin, natural-resin-modified maleic acid resin, dammar, copal, shellac, gum rosin, hardening rosin, ester-gum-glycerin-ester-modified maleic acid resin, and styrene-butadiene copolymer can be employed.

It is preferable that the content ratio of the pigment component to the resin be in the range of 1:1~4 in terms of parts by weight. In addition to the above resins, polyolefin, polyolefin copolymer resins and waxes can also be employed.

Examples of such polyolefin and copolymer resins are as follows:

| Manufacturer | Commercial Name | Softening Point (°C.) |
|---|---|---|
| Union Carbide Corp. (U.S.A.) | DYNI | 102 |
| | DYNF | 102 |
| | DYNH | 102 |
| | DYNJ | 102 |
| | DYNK | 102 |
| Monsanto Co. (U.S.A.) | Orlizon 805 | 116 |
| | Orlizon 705 | 116 |
| | Orlizon 50 | 126 |
| Phillips Petroleum Co. (U.S.A.) | Marlex 1005 | 92 |
| Du Pont de Nemours, E.I. & Co. | Alathon 3 | 103 |
| | Alathon 10 | 96 |
| | Alathon 12 | 84 |
| | Alathon 14 | 80 |
| | Alathon 16 | 95 |
| | Alathon 20 | 86 |
| | Alathon 22 | 84 |
| | Alathon 25 | 96 |
| Allied Chemical Corp. (U.S.A.) | AC Polyethylene 1702 | 85 |
| | AC Polyethylene 671, 617A | 102 |

-continued

| Manufacturer | Commercial Name | Softening Point (°C.) |
|---|---|---|
| | AC Polyethylene 9, 9A | 117 |
| | AC Polyethylene 430 | 60 |
| | AC Polyethylene 405 | 96 |
| | AC Polyethylene 401 | 102 |
| | AC Polyethylene 540 | 108 |
| | AC Polyethylene 580 | 108 |
| Mitsubishi Rayon Co., Ltd. | BR-50 | 100 |
| | BR-80 | 105 |
| | BR-90 | 65 |
| | BR-95 | 80 |
| | BR-101 | 50 |
| | BR-102 | 20 |
| | BR-107 | 50 |
| Nihon Gas Chemical | Nikanol HP-70 | 70~90 |
| | Nikanol HP-100 | 105~125 |
| | Nikanol HP-120 | 125~145 |
| | Nikanol A-70 | 70~90 |
| | Nikanol A-100 | 110~130 |
| | Nikanol A-120 | 120~140 |
| Kodak Japan K.K. | Epolene N-14 | 105 |
| | Epolene E-15 | 96 |
| Sanyo Chemical Industries, Ltd. | Sanwax 131-P | 108 |
| | Sanwax 151-P | 107 |
| | Sanwax 161-P | 111 |
| | Sanwax 165-P | 107 |
| | Sanwax 171-P | 105 |
| | Sanwax E-200 | 95 |
| | Sanwax E-300 | 98 |
| | Viscol 330-P | 152 |
| | Viscol 550-P | 150 |
| | Viscol 660-P | 145 |
| | Viscol TS-200 | 145 |
| Quaker State Oil | QS-Wax | 65 |
| Junsei Chemical Co., Ltd. | Paraffin Wax | 60~90 |
| Hoechst A.G. (West Germany) | PED 521 | 104 |
| | PED 543 | 110 |
| | PED 153 | 99 |

The colorant comprising a pigment coated with a resin can be prepared by the previously described flushing method. In the present invention, humic acid, a humic acid salt or a humic acid derivative is employed during the process of dispersing a pigment. Humic acid is a base-soluble, amorphous, polymeric organic acid constituent of young coals with low carbonizing degree, such as peat and lignite. Humic acid is classified into two types, natural humic acid and synthetic humic acid, both of which contain nitrohumic acid.

In the present invention, both types of humic acids and humic acid derivatives such as nitrohumic acid can be employed.

In addition to the humic acid and derivatives thereof, salts of humic acid, such a sodium salt and ammonium salt thereof, can also be employed in the present invention.

A colorant for use in the present invention can be prepared as follows:

One of the humic acid, humic acid salts and humic acid derivatives (hereafter referred to as the humic acid component) is added to an aqueous dispersion of a pigment in an amount of 0.1 wt.% to 30 wt.% of the total weight of the aqueous dispersion. The mixture is kneaded very well in a kneader. The dispersion is further kneaded together with a resin solution in a kneader called a "flusher", whereby the water which covers each pigment particle is replaced with the resin solution. The water in the kneader is discarded, so that a dispersion of the pigment particles dispersed in the resin solution is obtained. This dispersion is dried and then the solvent is removed therefrom. As a result, a solid mass is obtained. The resulting solid mass is then crushed to powder, whereby a powder-like colorant is obtained. This colorant consists of the pigment particles with each particles being in its primary particle size, which particles are coated with the resin, and can be employed as the colorant for a liquid developer according to the present invention.

A liquid developer according to the present invention can be prepared by dispersing the powder-like colorant in a carrier liquid. As the carrier liquid, for instance, the following can be employed: petroleum-type aliphatic hydrocarbon with high electrically insulating properties (for instance, with the electric resistivity thereof being $10^{10}$ Ωcm or more) and with a low dielectric constant (for instance, with the dielectric constant thereof being 3 or less), n-hexane, ligroin, n-heptane, n-pentane, isodecane, isooctane, and halogenated derivatives thereof such as carbon tetrachloride and perchloroethylene. As the commercial products of the petroleum-type aliphatic hydrocarbon that can be employed in the present invention, there are Isopar E, Isopar G, Isopar L, Isopar H, Isopar K, Naphtha No. 6 and Solvesso 100, which are produced by Exxon Chemical Co., Ltd. These can be used alone or in combination.

By use of the humic acid component during the process of dispersing the resin component, the following effects can be obtained in the present invention:

(1) Since the humic acid component is well adsorbed on the particles of carbon black and other pigments, the colorants comprising carbon black particles and/or pigment particles treated with the humic acid compound can be dispersed nearly to the primary particle size.

(2) Since the humic acid component is a polyfunctional compound containing —COOH, —OH, —$C00NH_4$, —COONa, —$CON(CH_3)_2$ and other functional groups, when it is adsorbed on the surface of the pigment particles, it produces electric charges on the pigment particles, by which electric charges the stability of the dispersion of the pigment particles, that is, its long preservability, is attained.

(3) Since the humic acid component is similar in chemical structure to carbon black and is black in color, it also serves as a colorant.

For the above reasons, the liquid developer for electrophotography according to the present invention is capable of providing images with high density, high contrast in terms of the contrast assessed by a grey scale and excellent image fixing capability.

Preparation of the colorants for use in the present invention by the flushing method, using the humic acid component, will now be explained more specifically by referring to the following examples:

COLORANT PREPARATION EXAMPLE 1

A mixture of the following components was well stirred in a flusher:

| | Parts by Weight |
|---|---|
| Water | 500 g |
| Printex | 30 g |
| Alkali Blue | 20 g |
| Humic acid | 10 g |

To this mixture, 600 g of a 10% toluene solution of Beccasite P-720 was added, and the mixture was kneaded in the flusher. The mixture was then heated under reduced pressure, so that the water and the solvent were removed therefrom to the extent that the content of water in the colorant solid mass was 0.92%. This solid mass was crushed in a stone mill to fine particles with a particle size ranging from 0.05 μm to 0.1 μm, whereby Colorant Example No. 1 for use in the present invention was prepared.

COLORANT PRODUCTION EXAMPLES 2 THROUGH 10

Colorant Preparation Example 1 was repeated except that the components employed in Colorant Preparation Example 1 were replaced with those listed in Table 1, whereby Colorant Examples No. 2 through No. 10 for use in the present invention were prepared.

TABLE 1

| Colorant Preparation Ex. | Carbon Black | | Organic Pigment | | Resin | | Humic Component | |
|---|---|---|---|---|---|---|---|---|
| 2 | Special Black | 30 g | Phthalocyanine Green | 30 g | Hitalac-40-P | 800 g | Nitorohumic acid | 10 g |
| 3 | Raben | 30 g | Permanent Red | 20 g | Dammar | 900 g | Potassium huminate | 10 g |
| 4 | MA-100 | 50 g | Peacock Blue Lake | 50 g | Beckasite-1126 | 800 g | Sodium huminate | 20 g |
| 5 | Conductex 8C | 50 g | Brilliant Carmine 6B | 50 g | Harimac M-135G | 900 g | Ammonium huminate | 15 g |
| 6 | Carbon MA-11 | 25 g | Phthalocyanine Blue | 30 g | Shellac | 700 g | Ammonium huminate | 10 g |
| 7 | Printex G | 30 g | Alkali Blue | 20 g | Styrene - Butadiene Copolymer | 15 g | Ammonium huminate | 30 g |
| | | | | | Shellac | 700 g | | |
| 8 | Mitsubishi #44 | 50 g | — | | Sanwax 131-P | 100 g | Potassium huminate | 25 g |
| 9 | Mitsubishi #44 | 50 g | — | | AC Polyethylene 405 | 400 g | Humic acid | 30 g |
| | | | | | Sanwax 131-P | 100 g | dimethyl amide | |
| 10 | Mitsubishi #44 | 50 g | — | | Epolene E15 | 300 g | Humic acid dimethyl amide | 30 g |

Preparation of embodiments of a liquid developer for electrophotography according to the present invention will now be explained by referring to the following examples:

EXAMPLE 1

A mixture of the following components was kneaded in a ball mill for 72 hours, whereby 50 g of a concentrate toner was prepared:

| | |
|---|---|
| Colorant No. 1 (prepared in Colorant Preparation Example 1) | 20 g |
| Copolymer of lauryl methacrylate/acrylic acid (90:10 parts by weight) | 50 g |
| Isopar G | 100 g |

The thus prepared concentrate toner was dispersed in 2 l of Isopar H,. whereby a liquid developer No. 1 according to the present invention was prepared.

Copies were made by use of the liquid developer No. 1 in a commercially available copying machine DT-1200 (made by Ricoh Company, Ltd.). The result was that images with an image density of 1.33, a background density of 0.10, an image contrast with a reproduction of 9 steps in terms of the contrast assessed by a grey scale, and an image fixing performance of 82%.

The image fixing performance was determined as follows: 10 minutes after an image was formed on a copy sheet by the above-mentioned copying machine, the image density was measured by a Macbeth densitometer. The image was then rubbed with an ordinary rubber eraser 10 times in an ordinary manner, for instance, as in the case of erasing marks written by a pencil, and the density of the rubbed image was measured by the Macbeth densitometer. The second image density was compared with the first image density on the basis that the first measured image density was 100%, so that the image fixing performance was determined. In this example, the second image density was 82% of the first image density.

COMPARATIVE EXAMPLE 1

A comparative colorant No. 1 was prepared in the same manner as in Colorant Preparation Example 1 except that the humic acid employed in the Colorant Preparation Example 1 was not employed. Example 1 was repeated except that the colorant No. 1 prepared in Example 1 was replaced with the above prepared comparative colorant No. 1, whereby a comparative developer No. 1 was prepared. Copies were made and the image density, image contrast and image fixing performance were measured in the same manner as in Example 1. The result was that the image density was 0.92, the background density was 0.20, the contrast was of 7 steps, and the image fixing performance was 60%.

EXAMPLES 2 THROUGH 10

Example 1 was repeated except that Colorant No. 1, the polymer and Isopar G employed in Example 1 were respectively replaced with 20 g of each of Colorants No. 2 through No. 10 which were respectively prepared in Colorant Preparation Examples No. 2 through No. 10, 50 g of each polymer listed in Table 2 and 100 g of Isopar H, whereby Liquid Developers No. 2 through No. 10 according to the present invention were prepared.

TABLE 2

| Example No. | Colorant (20 g) | Polymer (50 g) |
|---|---|---|
| 2 | Colorant No. 2 | LMA/AA (90/10) (wt. %) |
| 3 | Colorant No. 3 | LMA/AA (90/10) (wt. %) |
| 4 | Colorant No. 4 | LMA/AA (90/10) (wt. %) |
| 5 | Colorant No. 5 | LMA/DA (90/10) |
| 6 | Colorant No. 6 | LMA/DA (90/10) |
| 7 | Colorant No. 7 | LMA—GMA—MAA—MMA (60:5:2:33) Graft Polymer |
| 8 | Colorant No. 8 | LMA—GMA—MAA—MMA (60:5:2:33) Graft Polymer |
| 9 | Colorant No. 9 | Rosin-modified maleic acid resin |
| 10 | Colorant No. 10 | Rosin-modified maleic acid resin |

In the above table, LMA stands for lauryl methacrylate; AA, acrylic acid; DA, diethylaminoethyl methacrylate; GMA, glycidyl methacrylate; MAA, methacrylic acid; and MMA, methyl methacrylate.

The Liquid Developers No. 2 through No. 10 were also subjected to the same performance tests as were done to the Liquid Developer No. 1. The results are shown in Table 3.

Furthermore, Comparative Liquid Developers No. 2 through No. 10 were prepared in the same manner as in Examples No. 2 through No. 10 except that humic acid component was not employed as in Comparative Example 1.

TABLE 3

| | Image Density | Background Density | Grey Scale Contrast | Image Fixing Performance |
|---|---|---|---|---|
| Example 2 | 1.36 | 0.09 | 10 | 83 |
| Comparative Example 2 | 1.02 | 0.09 | 9 | 61 |
| Example 3 | 1.29 | 0.10 | 10 | 80 |
| Comparative Example 3 | 1.04 | 0.13 | 10 | 58 |
| Example 4 | 1.42 | 0.08 | 11 | 78 |
| Comparative Example 4 | 1.11 | 0.12 | 8 | 62 |
| Example 5 | 1.38 | 0.09 | 10 | 77 |
| Comparative Example 5 | 0.92 | 0.13 | 7 | 58 |
| Example 6 | 1.43 | 0.11 | 10 | 81 |
| Comparative Example 6 | 1.11 | 0.16 | 9 | 62 |
| Example 7 | 1.38 | 0.09 | 11 | 76 |
| Comparative Example 7 | 1.00 | 0.11 | 8 | 68 |
| Example 8 | 1.28 | 0.10 | 12 | 83 |
| Comparative Example 8 | 0.92 | 0.10 | 9 | 68 |
| Example 9 | 1.34 | 0.10 | 10 | 78 |
| Comparative Example 9 | 0.89 | 0.13 | 9 | 55 |
| Example 10 | 1.26 | 0.09 | 10 | 69 |
| Comparative Example 10 | 1.11 | 0.09 | 9 | 50 |

What is claimed is:

1. A liquid developer for electrophotography comprising a highly electrically insulating carrier liquid having a low dielectric constant and a colorant comprising a pigment component prepared by treating pigment particles with an effective amount of a humic acid component selected from the group consisting of humic acid, a humic acid salt and a humic acid derivative, and then coating said pigment particles with a resin component, said colorant being dispersed in said highly electrically insulating carrier liquid.

2. A liquid developer for electrophotography as claimed in claim 1, wherein said pigment component is selected from the group consisting of carbon black and organic pigments.

3. A liquid developer for electrophotography as claimed in claim 1, wherein said pigment component comprises a mixture of an organic pigment and carbon black with the mixing ratio of the respective components being in the range of 1:2~20 in terms of parts by weight.

4. A liquid developer for electrophotography as claimed in claim 1, wherein the content ratio of said pigment component to said resin for coating said pigment component is in the range of 1:1~4 in terms of parts by weight.

5. A liquid developer for electrophotography as claimed in claim 1, wherein component humic acid salt is selected from the group consisting of sodium huminate, potassium huminate and ammonium huminate.

6. A liquid developer for electrophotography as claimed in claim 1, wherein said humic acid component is selected from the group consisting of nitrohumic acid and humic acid dimethyl amide.

7. In a liquid developer for electrophotography comprising a dispersion of particles of a colorant dispersed in a highly electrically insulating carrier liquid having an effective amount of a low dielectric constant, the improvement which comprises: said colorant consists essentially of pigment particles having a humic acid component adsorbed on the surfaces thereof and having an overlying coating of a binder resin which is slightly soluble or insoluble in said carrier liquid, said humic acid component being effective to maintain said pigment particles as dispersed particles of primary particle size, said humic acid component being selected from the group consisting of humic acid, salts and derivatives of humic acid.

8. A liquid developer as claimed in claim 7 which has been prepared by dispersing particles of said pigment component and said humic acid component in water to form a dispersion containing from 0.1 to 30 wt.% of said humic acid component, then adding a solution of said resin dissolved in an organic solvent and kneading the thus-formed mixture so as to replace the water that covers the surfaces of said particles with said solution of said resin, then removing the water from the mixture to obtain a dispersion of the pigment particles dispersed in said solution of said resin in said solvent, and then removing said solvent from the mixture to obtain dry solids, then pulverizing said dry solids to form particles and dispersing said particles in said carrier liquid.

9. A liquid developer as claimed in claim 8 in which said humic acid component contains functional groups which produce electric charges on said pigment particles.

* * * * *

UNITED STATES PATENT AND TRADEMARK OFFICE

CERTIFICATE OF CORRECTION

PATENT NO. : 4 595 646

DATED : June 17, 1986

INVENTOR(S) : Kazuo TSUBUKO et al

It is certified that error appears in the above-identified patent and that said Letters Patent is hereby corrected as shown below:

Column 8, line 25; after "having" insert ---an effective amount of---.

Signed and Sealed this

Sixteenth Day of December, 1986

*Attest:*

DONALD J. QUIGG

*Attesting Officer*

*Commissioner of Patents and Trademarks*